US005179899A

United States Patent [19]

Burger et al.

[11] Patent Number: 5,179,899

[45] Date of Patent: Jan. 19, 1993

[54] TOWER PRINTING SYSTEM HAVING MULTIPLE VERTICALLY STACKED SATELLITE PRINTING STATIONS

[75] Inventors: Ranier Burger; Georg Riescher, both of Augsburg, Fed. Rep. of Germany

[73] Assignee: Man Roland Druckmaschinen AG, Offenbach-am-Main, Fed. Rep. of Germany

[21] Appl. No.: 595,358

[22] Filed: Oct. 9, 1990

[30] Foreign Application Priority Data

Nov. 29, 1989 [DE] Fed. Rep. of Germany ..... 3939432

[51] Int. Cl.[5] ..... B41F 5/18

[52] U.S. Cl. ..... 101/181; 101/180; 101/221; 101/138

[58] Field of Search ..... 101/177, 179, 180, 181, 101/220, 221, 228, 138, 139

[56] References Cited

U.S. PATENT DOCUMENTS

| | | | |
|---|---|---|---|
| 2,050,031 | 8/1936 | Wood | 101/179 X |
| 3,416,444 | 12/1968 | Cahn | 101/181 |
| 3,604,350 | 9/1971 | Rosenstadt | 101/181 |
| 3,761,001 | 9/1973 | Bolza-Schunemann et al. | 101/181 X |
| 4,281,595 | 8/1981 | Fujishiro | 101/181 X |
| 4,393,772 | 7/1983 | Burger | 101/228 X |
| 4,401,028 | 8/1983 | Köbler et al. | 101/228 X |
| 4,577,559 | 3/1986 | Burger | 101/228 X |

FOREIGN PATENT DOCUMENTS

| | | |
|---|---|---|
| 0242649 | 10/1987 | European Pat. Off. . |
| 748233 | 3/1944 | Fed. Rep. of Germany . |
| 2024482 | 2/1972 | Fed. Rep. of Germany . |
| 2330277 | 1/1975 | Fed. Rep. of Germany . |
| 2928539 | 2/1980 | Fed. Rep. of Germany . |

OTHER PUBLICATIONS

Textbook by Oskar Frei "Techniken, Systeme, Maschinen" (Technology, Systems and Machines), published by Polygraph publishers, 1979, pp. 9 and 10.

*Primary Examiner*—Edgar S. Burr
*Assistant Examiner*—Lynn D. Hendrickson
*Attorney, Agent, or Firm*—Frishauf, Holtz, Goodman & Woodward

[57] ABSTRACT

Two satellite printing stations (2, 3) are located vertically above each other, and a web (22) is guided first about a common impression cylinder (13) of the lower printing station, then upwardly about a common impression cylinder (4) of the upper printing station (2). To prevent set-off of freshly printed ink in the lower printing station (3) on the common impression cylinder (4) of the upper printing station, blanket cylinders (6, 7, 10, 12) of the upper printing station (2) are so located that, respectively, two blanket cylinders (6, 7, 10, 12) of printing couples of the upper printing stations are in vertical alignment so that a tangent at the nip between these blanket cylinders will be in an essentially horizontal plane (31). The blanket cylinders are spaced from each other to leave a clearance gap, and an image maintenance device (30), for example a spray bar or rod, a washing apparatus or the like, is located in the clearance space to apply a film of liquid against the upper common impression cylinder (4) or to clean the upper impression cylinder (4), thereby avoiding set-off of freshly applied ink in the lower printing station (3) on the impression cylinder (4) of the upper printing station, or to periodically or continuously clean the common impression cylinder (4) of the upper printing station. Preferably, the web is guided about the lower printing station in form of a wide-open upstanding U, and guided about the upper printing station in form of a downwardly facing wide-open U to provide access to maintenance and service personnel to the respective printing stations between the leg portions of the web forming the U.

6 Claims, 1 Drawing Sheet

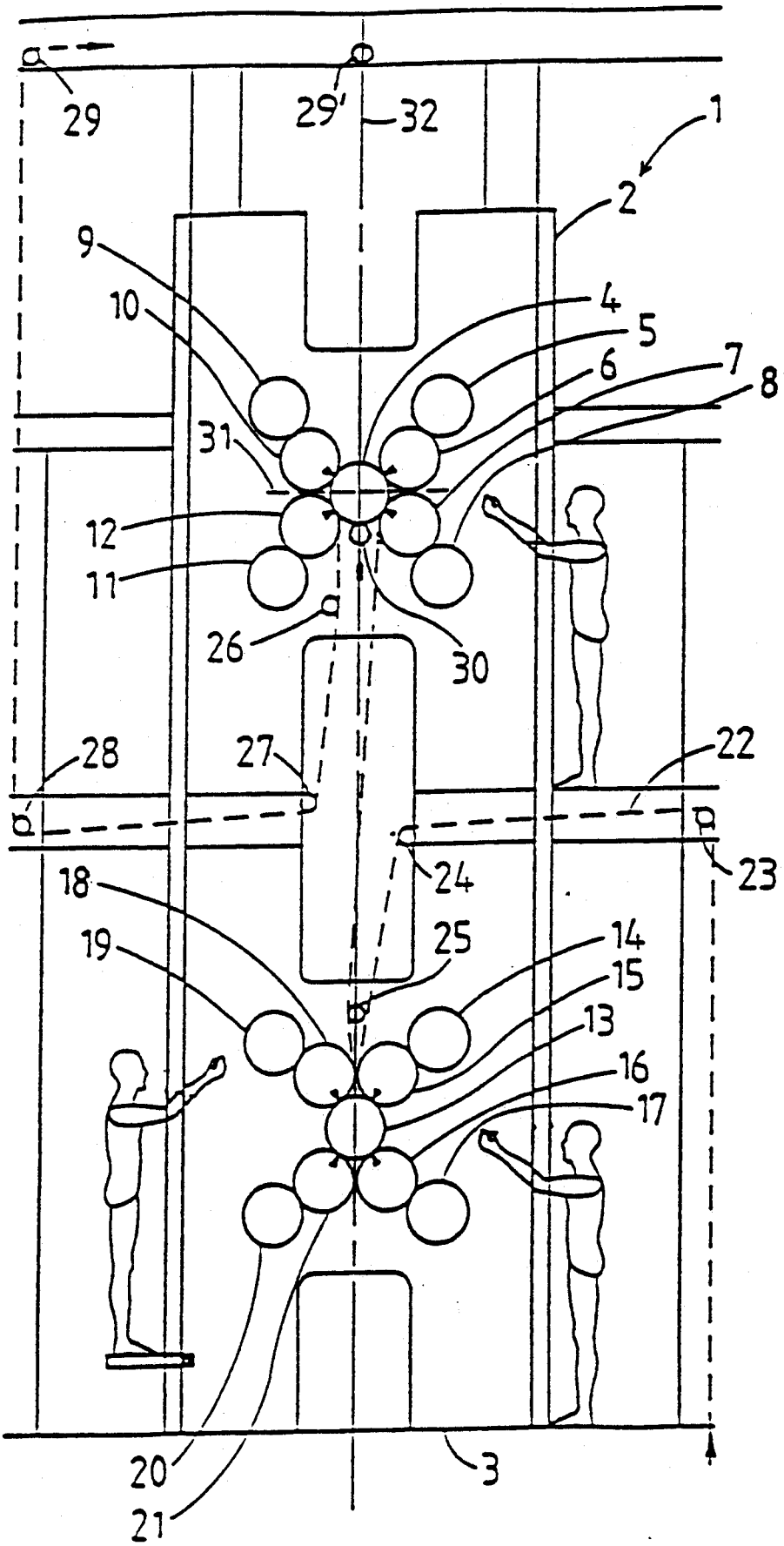
29
29'
32
1
2
9
10
4
5
6
7
8
31
12
11
26
30
28
27
22
23
24
18
19
25
14
15
13
16
17
20
21
3

TOWER PRINTING SYSTEM HAVING MULTIPLE VERTICALLY STACKED SATELLITE PRINTING STATIONS

Reference to related publications:

Textbook by Oskar Frei "Techniken, Systeme, Maschinen" ("Technology, Systems and Machines"), published by Polygraph publishers, 1979, pp. 9 and 19 especially.

German Patent 748,233.

German Published Patent Application 20 24 482, Bayer et al, assigned to a predecessor company of the assignee of the present application.

German Patent Disclosure Document 23 22 77, Rau, assigned to a predecessor company of the assignee of the present application.

German Patent Disclosure Document 29 28 539, Feustel.

FIELD OF THE INVENTION

The present invention relates to printing machines, and more particularly to multiple vertically stacked satellite printing stations.

BACKGROUND

Satellite printing stations are usually defined as web offset printing stations or units designed on the common impression cylinder principle, that is, in which two or more printing couples, each including a plate cylinder and a rubber blanket cylinder are selectively operably engageable against a common impression cylinder. The referenced textbook by Oskar Frei "Techniken, Systeme, Maschinen" ("Technology, Systems and Machines"), published by Polygraph publishers, 1979, pp. 9 and 19 especially, describes such printing systems and also that it is known to locate such satellite printing stations above each other. In one such arrangement, four blanket cylinders are engaged with a common impression cylinder, also referred to as the satellite cylinder. A web can thus be printed on one side with four different colors, to provide a 4/0 printing image. Placing such satellite printing units or stations above each other, for example to apply prime printing by one satellite printing station, and verso printing by the other printing station, typically the upper printing station, causes problems. Such combined printing stations, one above the other, are also known as tower printing systems. While printing can be obtained thus by one station with 4/0 image production, the upper station with 0/4 image printing, to result in perfected 4/4 printing, the danger arises that the still fresh and wet ink from the lower cylinder, and forming the 4/0 print, will set off or slur on the satellite or common impression cylinder of the upper printing station or unit. Additionally, problems arise regarding accessibility of the respective printing stations when the web has been threaded therethrough, and especially if, as frequently is the case, the web is first guided to run over the lower printing station and then towards the upper printing station and about the upper impression cylinder, to obtain the perfected 4/4 printed substrate or web.

THE INVENTION

It is an object to improve a tower printing system having at least two vertically positioned printing units or stations which has improved accessibility for maintenance of the printing stations and which effectively prevents set-off, slurring or smearing of the freshly applied ink in the subsequent or second satellite printing system; preferably, continuous or rapidly sequential cleaning should be possible of the common impression cylinder which receives the web on which the first prime printing has just been applied.

Briefly, at least one of the satellite printing stations or units, and especially the upper one, is so arranged that the blanket cylinders of a printing couple can be engaged against not only the associated impression cylinder but also against each other, and in the latter case such that a tangent at the nip is in an at least approximately horizontal plane; the blanket cylinders of the printing couples are so located that a horizontal space is left beneath the impression cylinder, and an image maintenance apparatus, to be described hereinafter, is provided, located in this clear space. The web, then, is guided from the impression cylinder of the lower printing station in such a manner that the clear space in which the image maintenance device is located is partly unobstructed, that is, is close to the end limits of this clear space, which, usually, means comparatively close to, but out of contact with the blanket cylinders which define the clear space.

An image maintenance device, as referred to hereinafter, is an apparatus which provides for wetting and/or cleaning of the cylinder to prevent set-off or slurring of ink thereon; set-off is usually defined as the unwanted transfer of ink from the substrate to another surface, here the impression cylinder; and slurring, as printing faults caused by a false movement between the inked image and the substrate, for example due to slippage about the impression cylinder or smearing on the impression cylinder of the second, and an upper unit or station. This device may be, for example, a washing device such as washing water, for example applying a spray, to form an ink repellent damping or water layer on the impression cylinder, thereby maintaining the already printed image on the substrate web.

In contrast to the prior art, in which adjacent blanket cylinders of a satellite printing station were engageable against each other in an essentially vertical plane, the present invention teaches that these blanket cylinders are to be relocated, and preferably the upper one of the satellite printing stations is so constructed that adjacent blanket cylinders can be engaged against each other in an approximately horizontal plane, with respect to a tangent through the engagement nip. This relocation can be done in all the vertically arranged printing stations or units, but should be applied to at least that one which, looked at with respect to applied printing, is the subsequent one, that is, the printing station which receives a web which already has printed subject matter applied to one side thereof.

The system has the advantage that, by so relocating the blanket cylinders of at least the one respective satellite printing station will permit enough room or space to locate a cleaning, or in general, image maintenance device to be operatively associated with the common impression cylinder. The arrangement, then, permits that the substrate web, having just been printed by the printing couples associated with the lower satellite printing stations or units is guided, from below, about the upper satellite cylinder and alongside the image maintenance device, to permit application of printed subject matter to the other side of the web. The web, then having perfect printing applied, for example 4/4 printing, is thereafter guided at the other side of the image maintenance device within the clearance space between the cylinders. Of course, all the printing units or stations can be constructed similarly, but it is of particular importance to provide the space and the image maintenance device in that one of the printing units or stations which receives the web which already has one side thereon supplied with printed subject matter.

The circumference of the satellite cylinder of the respective satellite printing stations can be the same as that of the other cylinders, or it may be larger, for example twice the diameter. More than one satellite cylinder may be included in each one of the satellite stations.

The arrangement has the advantage that the web can be readily guided, preferably from below, first in a rising branch, then horizontally and to the first satellite printing station; then, guided about the first satellite printing station and in another rising branch to the second, and upper satellite printing station. This provides for accessibility to the lower printing station from both sides thereof, with the web threaded thereabout. The upper satellite printing stations, receiving the web in a rising branch, is accessible at the side of the rising branch; the other side of the upper printing station likewise is readily accessible, so that the upper station is accessible from both sides.

DRAWING

The single FIGURE is a highly schematic and diagramatic side view of two vertically located printing stations of a tower printing system.

DETAILED DESCRIPTION

The tower printing station 1 has an upper satellite printing station or unit 2 and a lower printing station or unit 3. Only the upper printing station 2 is constructed in accordance with the concepts of the present invention; the lower printing station is conventional. Of course, both printing stations can be identically constructed as the upper one. This is not necessary, however, and the illustration, with the lower printing station 3 being conventional, also provides a good contrast between known constructions and the teaching of the present invention.

The upper satellite station or unit has a satellite or common impression cylinder 4. The diameter of the common impression or satellite cylinder 4 is the same as that of the cylinders of the four printing couples associated therewith.

The printing couples forming a plate cylinder and a blanket cylinder 5, 6; 8, 7; 9, 10; 11, 12 are each associated with the common impression cylinder 4.

The lower satellite printing unit or station 3 which, as noted above, can be constructed in well known manner or in accordance with the present invention, has a single common or satellite cylinder 13, operatively associated with plate cylinder-blanket cylinder couples 14, 15; 17, 16; 19, 18; and 20, 21. The diameters of all the cylinders of the lower printing couple are, as shown, the same.

A web 22 is guided to the tower system 1, preferably from below, first to the lower satellite station 3, then to the upper satellite station 2. In the example shown, it can be supplied with printed subject matter in four colors at both sides, that is, prime and verso 4/4 printing. To obtain ready accessibility of the lower satellite station or unit 3, the web 22 is first guided at a suitable distance from the tower unit 1 in a rising branch, then about a paper guide roller or pipe 23, then horizontally and over a guide roller 24, and then downwardly to the common impression cylinder 13. The web 22 is looped about the impression cylinder 13, so that one side thereof can have four different colors, or subject matter printed thereon, that is, applying a 4/0 prime printing. The paper web 22, with the 4/0 printing applied, is then guided upwardly. It may be engaged by an additional guide roller 25 which, as noted, will engage the web at the still blank verso side.

The satellite printing station 2 is constructed in accordance with the present invention. Blanket cylinders 6, 7 and 10, 12 can be engaged against the satellite cylinder 4—see the drawing—and against each other, in pairs. The engagement nip of the pairs of blanket cylinders 6, 7; 10, 12 is in an essentially horizontal plane 31. This will result in a free or clearance space between the blanket cylinders 7 and 12, see the drawing. In accordance with a feature of the invention, an image maintenance device 30 is located in this free space.

The image maintenance device 30 may, for example, be a pipe or the like which sprays a liquid, preferably washing water or the like, against the impression cylinder 4. The impression cylinder 4 may have a chrome surface thereon. As a result, a protective water layer will form between the freshly printed 4/0 subject matter on the web and the impression cylinder 4, preventing set-off of ink from the web on the impression cylinder 4, or slurring or smearing thereon. The washing liquid, typically water, will act like a damping liquid, forming a protective damping liquid layer. For simplicity, and since the apparatus 30 maintains the image, and provides for cleaning and/or set-off prevention, it has been termed an image maintenance device. Such spray devices are well known.

The device 30, for example, is a rod or pipe which directs a mist against the satellite cylinder 4 so that, when the web 22 is wound about the satellite cylinder 4, set-off of ink thereon is effectively prevented. It is, of course, also possible to permit some set-off if the image maintenance device also includes a cleaning system which, permanently, or in intervals, cleans the cylinder 4 by removal of set-off ink therefrom. The exact construction of the image maintenance device 30 will depend on the path length between the respective satellite printing stations 2, 3, characteristics, for example ink absorbency of the paper, the ink used and the like, and can be easily determined when considering the known characteristics of ink, the substrates and the set-off characteristics with respect to engaged surfaces, such as the surface of the satellite cylinder 4.

In accordance with a feature of the invention, thus, the web 22 is guided in a rising branch at one side of the image maintenance device 30 to the upper satellite cylinder 4, and, for example after application of further printed subject matter, for example a 0/4 verso printing on the web 22, the web 22 is led then downwardly at the other side of the image maintenance device 30; and thereafter, over paper or web guide rollers or pipes 26, 27, 28 and 29 outwardly from the upper satellite printing station 2 and away from the tower printing system 1.

Supply of the web 22 to the lower satellite station 3 is, generally, in form of an inverted U; removal of the then perfected printed web is, generally, in form of an upright U. By maintaining a suitable distance of the legs of the "U"s by appropriately placing the guide rollers 23, 28, 29, for example, the upper as well as the lower satellite printing stations 2, 3 are readily accessible from both sides, as schematically indicated by the shadow representation of operator personnel.

The image maintenance device, forming a set-off prevention or cleaning apparatus 30, is located between the lower blanket cylinder 7, 12 of the upper printing station 2 is located in a preferably central vertical plane 32, positioned between vertically stacked blanket cylinders 7, 6 and 12, 10. Engagement or disengagement, or operative association and disconnection of the image maintenance device 30 with the impression cylinder 4 preferably moves the image maintenance device 30 in essentially this plane.

The blanket cylinder pairs 6, 7 can be engaged against each other for blanket-to-blanket printing, or, preferably, disengaged from each other when such printing is not desired or necessary.

The path of the web 22 as illustrated is intended for 4/4 printing. Of course, lesser numbers of printing images can be applied and, for example, the web can be passed over either one, or both of the impression cylinders 4, 13 in an essentially vertical direction without guidance about the rollers 27, 28, and about an auxiliary roller 29' positioned, for example, in the central plane 32, or a vicinity thereof.

Various changes and modifications may be made, and any features described herein may be used with any of the others, within the scope of the inventive concept.

I claim:

1. Tower printing system (1) for printing on a substrate web (2) having at least two vertically stacked satellite printing stations (2, 3), each of said satellite printing stations including a common impression cylinder (4, 13), whereby one impression cylinder will form a lower impression cylinder and another impression cylinder (4) will form an upper impression cylinder, and at least four printing couples (5, 6; 8, 7; 9, 10; 11, 12; 14, 15; 17, 16; 19, 18; 20, 21), each of said printing couples having a blanket cylinder and a plate cylinder, two each of said printing couples being operatively associated with a respective one of the common impression cylinders, the blanket cylinders being engageable against the respective impression cylinder, and being selectively engageable against each other, and wherein, in accordance with the invention, in at least one of said satellite printing stations, two blanket cylinder of said at least two printing couples (8, 7; 11, 12) form vertically associated blanket cylinder pairs (6, 7; 10, 12) in which the blanket cylinders of the pairs are selectively engageable against each other, and positioned such that a tangent of the engagement line or nip of said two vertically positioned blanket cylinders of the pairs is in an at least approximately horizontal plane (31);

the blanket cylinders (6, 7; 10, 12) of the pairs are horizontally spaced from each other with respect to a vertical center line (32) passing through the respective common impression cylinder (4) to define a clearance space or gap therebetween;

an image maintenance device (30) is provided, located in the clearance space, said image maintenance device being operatively associated with the respective common impression cylinder (4); and web guide means (23, 24, 25, 26, 27, 28, 29) are provided for guiding the web (22) about the lower (13) impression cylinder, then upwardly about the upper (4) impression cylinder.

2. The system of claim 1, wherein said image maintenance device (30) comprises a liquid spray bar or pipe (30).

3. The system of claim 1, wherein the at least one satellite cylinders (4) have at least the same diameter as that of the cylinders of the printing couples associated therewith.

4. The system of claim 1, wherein said web guide means includes means guiding said web about the lower one (13) of said at least two impression cylinders, while four printing couples (14, 15; 17; 16; 19, 18; 20, 21) are operatively associated therewith, and apply at least one, and optionally four printed subject matter images (4/0; 0/4) thereon, said guide means guiding said web about said lower one satellite cylinder (13), and removing said web from said lower one of said at least two satellite cylinders in an upward direction;

and wherein said web guide means further guides said web from below to the upper satellite cylinder (4) from below and about said upper satellite cylinder (4) for applying at least one further image, and optionally up to four further images on the verso side (0/4) of said web, whereby said web will have at least 1/1 and optionally up to 4/4 printed subject matter applied thereto, said web guide means then guiding said web, after being looped about said upper impression cylinder (4), downwardly and then laterally outwardly from the printing station (2) with which said one impression cylinder (4) is associated.

5. The system of claim 4, wherein said web guide means guide the web to the lower one (13) of said impression cylinders in a path forming approximately an upstanding U, and remove the web from said upper common impression cylinder (4) in form of an essentially inverted U; and wherein the essentially parallel legs of said inverted U and upstanding U are spaced apart sufficiently to permit access to the sides of the printing stations for maintenance or service.

6. The system of claim 5, wherein said web guide means include a guide roller (29') guiding said web (22) after application of two color printing in the upper one (2) of said vertically stacked satellite printing stations, upwardly and away from the upper one (2) of said satellite printing stations.

* * * * *